US006715454B2

(12) United States Patent
Yonezawa

(10) Patent No.: US 6,715,454 B2
(45) Date of Patent: Apr. 6, 2004

(54) OUTBOARD MOTOR INCLUDING WATER-COOLED V-ENGINE

(75) Inventor: Makoto Yonezawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/145,048

(22) Filed: May 14, 2002

(65) Prior Publication Data

US 2002/0170509 A1 Nov. 21, 2002

(30) Foreign Application Priority Data

May 15, 2001 (JP) ..... 2001-144546

(51) Int. Cl.[7] ..... F02F 1/10
(52) U.S. Cl. ..... 123/41.72; 123/195 P
(58) Field of Search ..... 123/41.72, 195 P, 123/41.67, 54.4

(56) References Cited

U.S. PATENT DOCUMENTS 4,066,057 A * 1/1978 Hale ..... 123/193.3
4,129,103 A * 12/1978 Pichl ..... 123/54.4
5,950,425 A 9/1999 Takahashi et al. ..... 60/321

FOREIGN PATENT DOCUMENTS

JP 63158530 10/1988

* cited by examiner

*Primary Examiner*—Tony M. Argenbright
*Assistant Examiner*—Katrina B. Harris
(74) *Attorney, Agent, or Firm*—Adams & Wilks

(57) ABSTRACT

An outboard motor includes a water-cooled V-engine. The engine includes right and left cylinder block portions each having plural cylinders formed therein. The cylinders of each cylinder block portion are vertically juxtaposed. Cylinder heads are disposed behind the cylinder block portions. The outboard motor has horizontal and vertical shafts. The outboard motor can tilt up on the horizontal shaft and pivot sideways on the vertical shaft. The cylinders of each cylinder block portion have a cooling jacket formed therein. The lowermost cylinder has a discharge portion formed at an outermost part thereof. The discharge portion is designed to discharge out cooling water remaining in the cooling jacket.

9 Claims, 7 Drawing Sheets

OUTBOARD MOTOR INCLUDING WATER-COOLED V-ENGINE

FIELD OF THE INVENTION

The present invention relates generally to an outboard motor including a water-cooled V-engine having cooling water jackets formed therein, and in particular to the engine designed such that cooling water such as sea water remaining in the cooling water jackets is readily discharged out of the outboard motor when the outboard motor is tilted up and pivoted either rightward or leftward.

BACKGROUND OF THE INVENTION

Outboard motors having water-cooled engines are well known in the art and attached to sterns of boats. The outboard motors may be tilted up out of water for the purpose of maintenance. At this time, cooling water such as sea water remaining in cooling water jackets formed in the engines should be discharged out so as to prevent corrosion or rusting of the engines.

Japanese Utility Model Laid-Open Publication No. SHO 63-158530 discloses an outboard motor including an engine having cooling water jackets formed therein. When the outboard motor is tilted up and pivoted sideways, the cooling water jackets discharge out unwanted cooling water, which remains therein, through a discharge port formed at an underside of a lowermost cylinder of the engine.

Because the engine is an in-line engine having cylinders provided in vertical juxtaposition, the remaining cooling water can be discharged out of the outboard motor.

Engines for use in the outboard motors include a water-cooled V-engine having two sets or rows of vertically juxtaposed plural cylinders provided at right and left sides thereof. Each set of the cylinders is spaced a predetermined angle (a first angle) away from a central longitudinal axis of a boat. If the outboard motor employing such a V-engine is tilted up and pivoted rightward (or otherwise leftward) by a second angle, the set of the cylinders provided at the right side (or otherwise the left side) of the engine is spaced away from the axis of the boat by angles obtained by adding up the second angle to the first angle. As a result, cooling water within the cooling water jackets would not be satisfactorily discharged out of the discharge port formed in the lowermost cylinder.

SUMMARY OF THE INVENTION

An object of the present invention is to provide an outboard motor including a V-engine designed to smoothly discharge out cooling water remaining therein when the outboard motor is tilted up and pivoted sideways.

According to one aspect of the present invention, there is provided an outboard motor including a water-cooled V-engine, a horizontal shaft, and a vertical shaft, the outboard motor being tiltable up on the horizontal shaft and pivotable sideways on the vertical shaft. The water-cooled V-engine comprises right and left cylinder block portions each having plural cylinders formed therein, the cylinders being vertically juxtaposed, and cylinder heads disposed behind the right and left cylinder block portions, respectively. The plural cylinders of each of the right and left cylinder block portions have a cooling jacket formed therein, the cooling jacket allowing cooling water to flow therethrough to thereby cool the plural cylinders, and the right and left cylinder block portions have discharge portions formed at the lowermost cylinders thereof, the discharge portions each communicating with the cooling jacket of the plural cylinders of each of the right and left cylinder block portions, for discharging out cooling water remaining in the cooling jacket.

In the illustrated embodiment as described hereinafter, the lowermost cylinders have the discharge portions positioned at the same level as centers thereof. Therefore, when the outboard motor is tilted up and pivoted sideways for the purpose of maintenance, the cooling water remaining in the cooling jackets is smoothly discharged out through the discharge portions. It thus becomes possible to advantageously protect the engine of the outboard motor against corrosion or rusting.

By thus providing the cylinders with only the discharge portions, the drainage of the cooling water remaining in the cooling jackets can be achieved. The discharge portions may be piped.

In a preferred form of the present invention, the cooling jackets of the right and left cylinder block portions include inside bottom portions inclined forwardly of the outboard motor, the inside bottom portions each being contiguous with the discharge portions, such that the cooling water remaining in the cooling jackets is successively directed along the inside bottom portions into the discharge portions when the outboard motor is tilted up.

The inside bottom portions are continuous with the discharge portions. The inside bottom portions are inclined forwardly of the outboard motor. When the outboard motor is tilted up for the purpose of maintenance, the cooling water remaining within the cooling jackets is directed along the inside bottom portions into the discharge portions. The cooling water is then drained out of the discharge portions.

Preferably, the cooling water discharged from the discharge portions is discharged out of the outboard motor through a cooling water supplying pipe for supplying cooling water to the cooling jackets.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
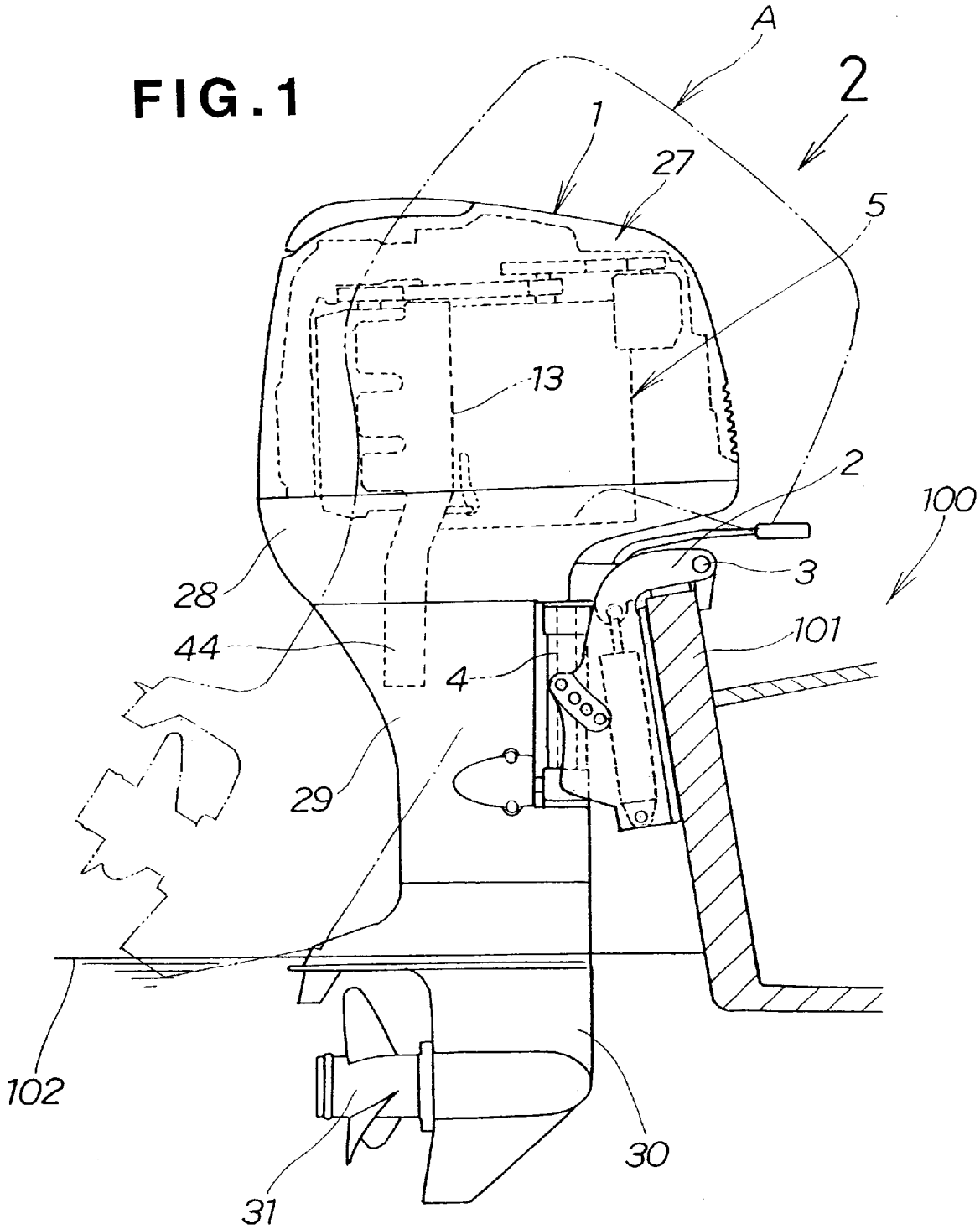
FIG. 1 is a side elevation view of an outboard motor of the present invention attached to a stern.

Referring now to FIG. 1, an outboard motor 1 includes an engine cover 27. A stern bracket 2 is positioned at a front part of the outboard motor 1. More specifically, the stern bracket 2 is disposed below the engine cover 27. The outboard motor 1 is detachably mounted via the stern bracket 2 to a stern 101 of a boat 100.

The outboard motor 1 includes a horizontal shaft 3. The outboard motor 1 mounted to the stern 101 is free to tilt or pivot up on the horizontal shaft 3 to undergo tilting movement about a horizontal axis. The outboard motor 1, when tilted up, is shown by a double-dot-and-dash line A of FIG. 1. The outboard motor 1, when tilted up, is exposed to the air with a screw 31 positioned above the surface 102 of water.

Figure 2:
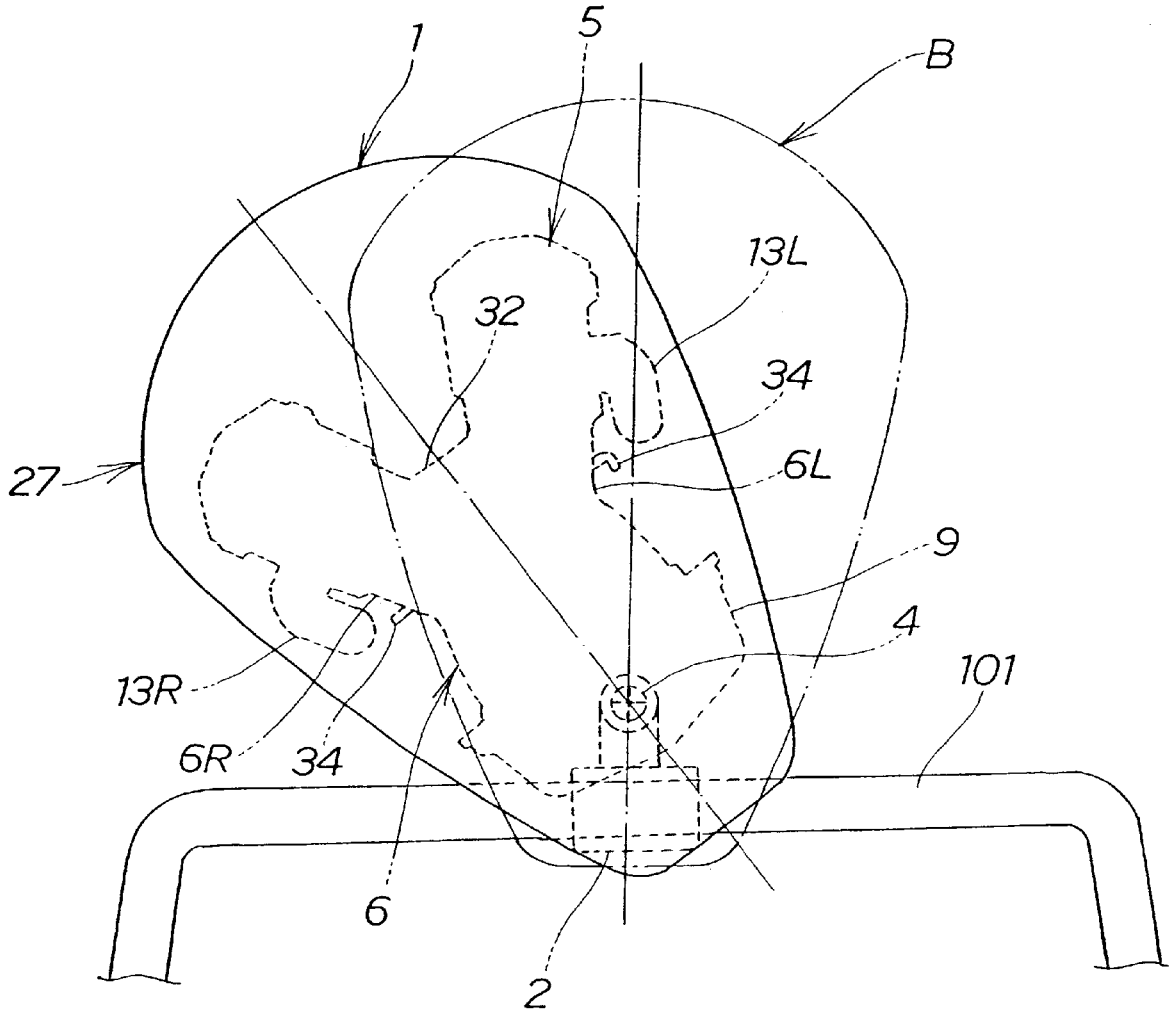
FIG. 2 is a view of the outboard motor as viewed in a direction designated 2.

The outboard motor 1 includes a vertical shaft 4. In addition to pivoting up, the outboard motor 1 can pivot sideways on the vertical shaft 4 to undergo sidewise pivotal movement about a vertical axis to thereby turn a boat. As shown by a solid line in FIG. 2, for example, the outboard motor 1 can pivot rightward. The boat can be propelled straight with the outboard motor 1 held in a neutral position as shown by a double-dot-dash line B.

Figure 3:
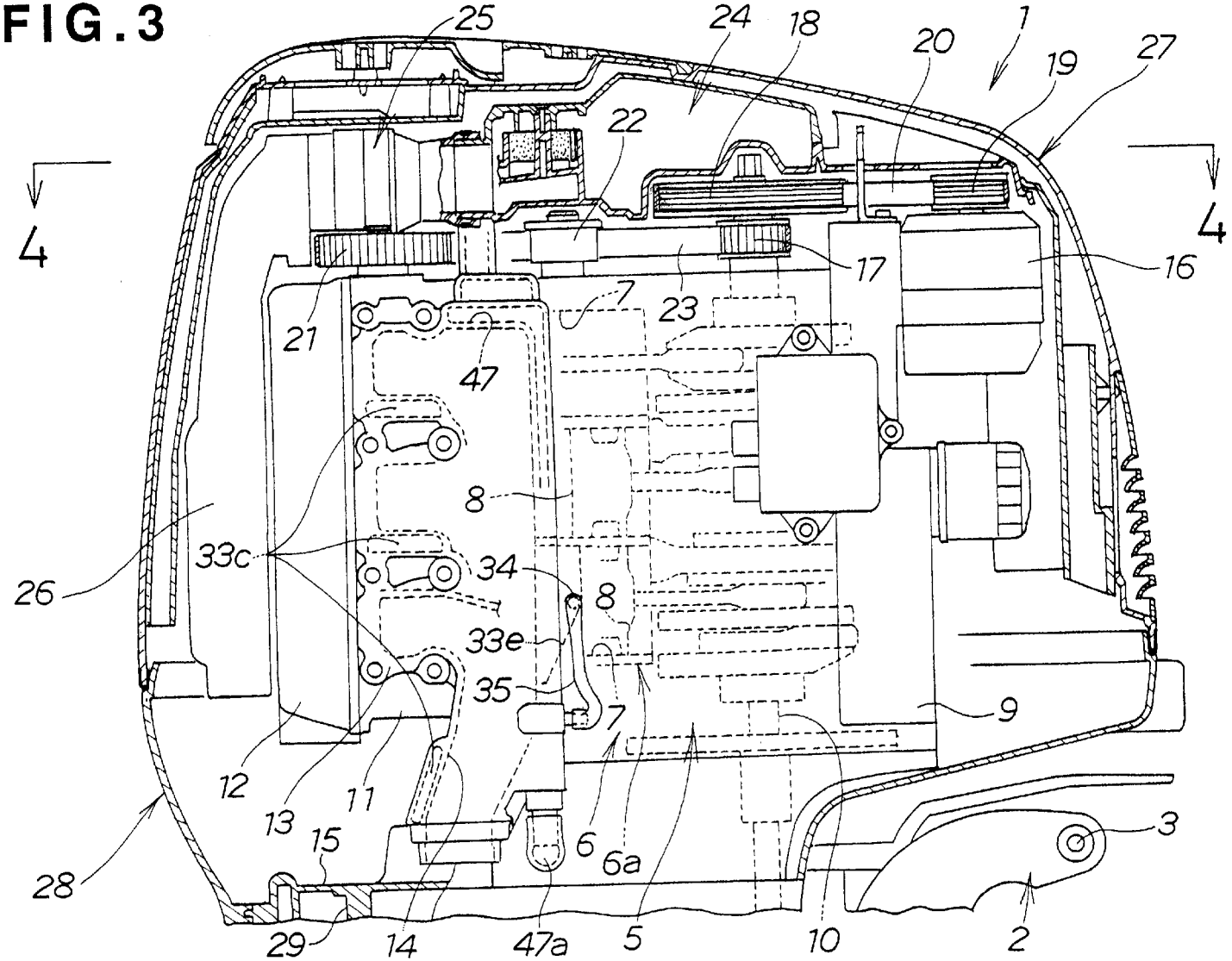
FIG. 3 is a view illustrating an upper part of the outboard motor, an engine cover being shown in vertical cross-section to reveal inner components such as an engine of the outboard motor.
Figure 4:
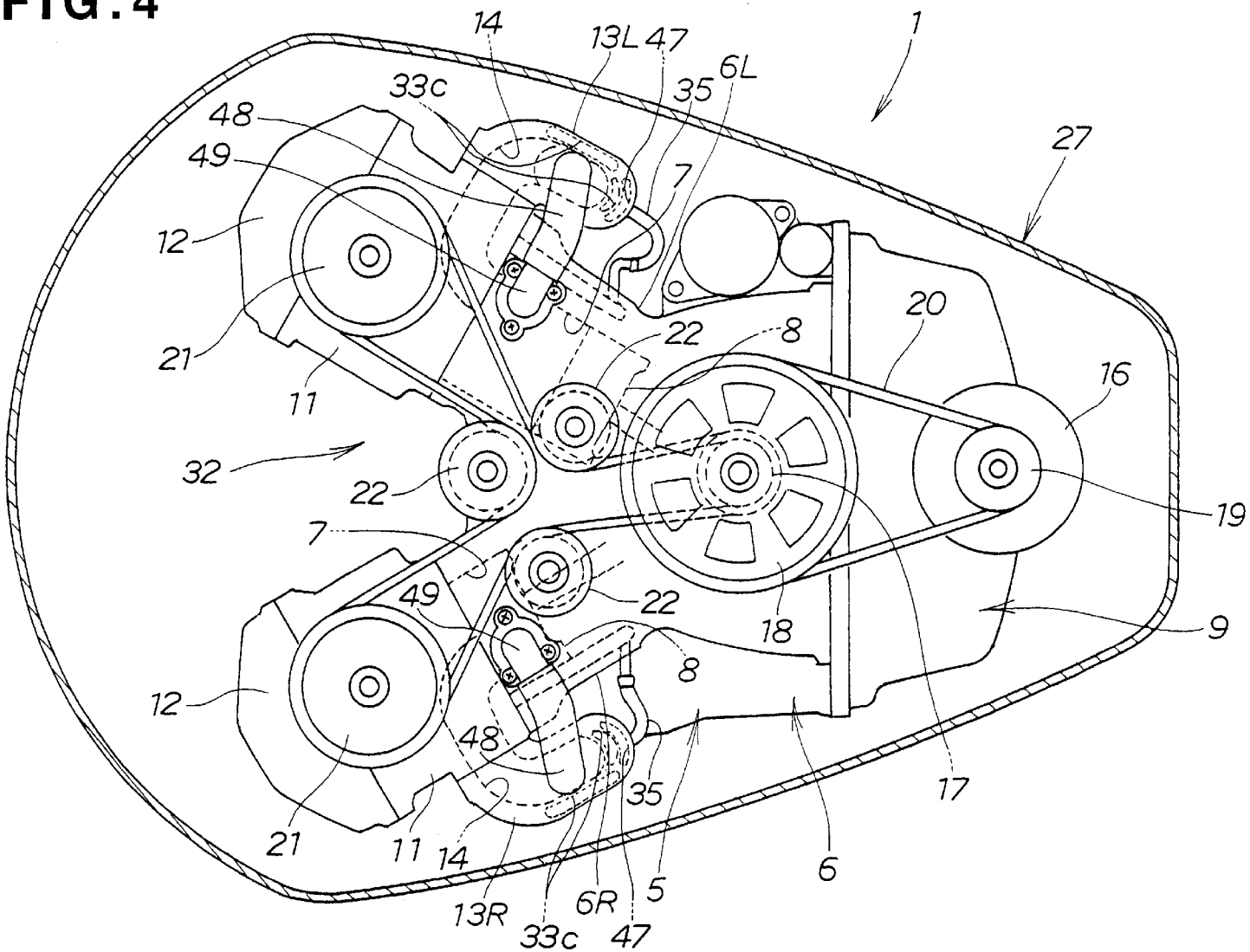
FIG. 4 is a cross-sectional view taken along line 4—4 of FIG. 4 with an intake muffler and an intake manifold of the engine omitted for the purpose of illustrating the engine.

With respect to FIG. 3 and FIG. 4, the outboard motor 1 includes a water-cooled V-six engine 5 having two sets or rows of three cylinders 7 each oriented horizontally.

The three cylinders 7 of each row are vertically disposed side by side. Each cylinder 7 has a piston 8 slidably fitted therein. The engine 5 includes a cylinder block 6 taking the form of a V when viewed in plan (FIG. 4). A crankcase 9 is disposed at a front side of the cylinder block 6. The respective pistons 8 are connected to a crankshaft 10.

Cylinder heads 11, 11 are disposed behind the cylinder block 6. Cylinder head covers 12, 12 are positioned behind the cylinder heads 11, 11. Exhaust manifolds 13R, 13L are disposed alongside the cylinder heads 11, 11. Each exhaust manifold 13 has an exhaust passageway 14 formed therein. A mount case 15 for supporting the engine 5 is disposed below the cylinder block 6. The mount case 15 has an inside space formed in a rear part thereof. The exhaust passageway 14 communicates with an exhaust pipe 44 through the inside space of the mount case 15, as will be discussed later. An extension case 29 has an exhaust gas expansion chamber 45 formed therein. The respective exhaust pipes 44, 44 extend through such an exhaust gas expansion chamber 45. Exhaust gas flows through the exhaust passageways 14, 14 and the exhaust pipes 44, 44 out of an exit formed at a lower part of the outboard motor 1. Such a lower part of the outboard motor is normally submerged in water.

A generator 16 is disposed at an upper portion of a front part of the engine 5. A first drive pulley 17 is mounted on an upper end of the crankshaft 10. A second drive pulley 18 is also mounted on the upper end of the crankshaft 10. The pulley 18 is positioned above the pulley 17 in coaxial relation thereto. A belt 20 runs over the pulley 18 and a driven pulley 19 of the generator 16. The pulleys 18, 19 and the belt 20 thus arranged are to transmit an output from the engine 5 to the generator 16. When supplied with the output of the engine 5, the generator 16 is energized to produce electricity.

Camshafts have their ends projecting upwardly from the cylinder heads 11, 11. Each camshaft is driven by a camshaft pulley 21. Guide pulleys 22, 22, 22 are disposed near the pulleys 21, 21. A belt 23 runs over the pulleys 17, 21, 21, 22, 22, 22. With this arrangement, the camshafts are driven by the output from the engine 5.

A box-shaped intake muffler (intake silencer) 24 is disposed above these pulleys and belts. The intake muffler 24 has its rear part communicating with an intake passageway formed in a throttle valve device 25. The throttle valve device 25 is connected to an intake manifold 26 disposed behind the cylinder head covers 12, 12.

The engine cover 27 covers the engine 5. An under cover 28 disposed below the engine cover 27 covers the mount case 15. The extension case 29 extends downwardly from the under cover 28. Provided under the extension case 29 is a gear case 30 (FIG. 1). The screw 31 projects rearwardly from the gear case 30. The crankshaft 10 has its lower end connected to a vertical drive shaft. The vertical drive shaft is to transmit the output from the engine 5 to the screw 31. When supplied with the output from the engine 5, the screw 31 is driven.

In FIG. 4, the intake muffler 24 and the intake manifold 26 are not shown for the purpose of explaining the engine 5.

Right and left cylinder block portions (right and left cylinder banks) 6R, 6L of the cylinder block 6 have a space 32 formed therebetween. The exhaust manifolds 13R, 13L are disposed outside the right and left cylinder block portions 6R, 6L, respectively.

Each cylinder 7 has a cylinder bore 7*a* disposed therewithin. The cylinder head 11 has combustion chambers 11*a* formed therein.

Figure 5:
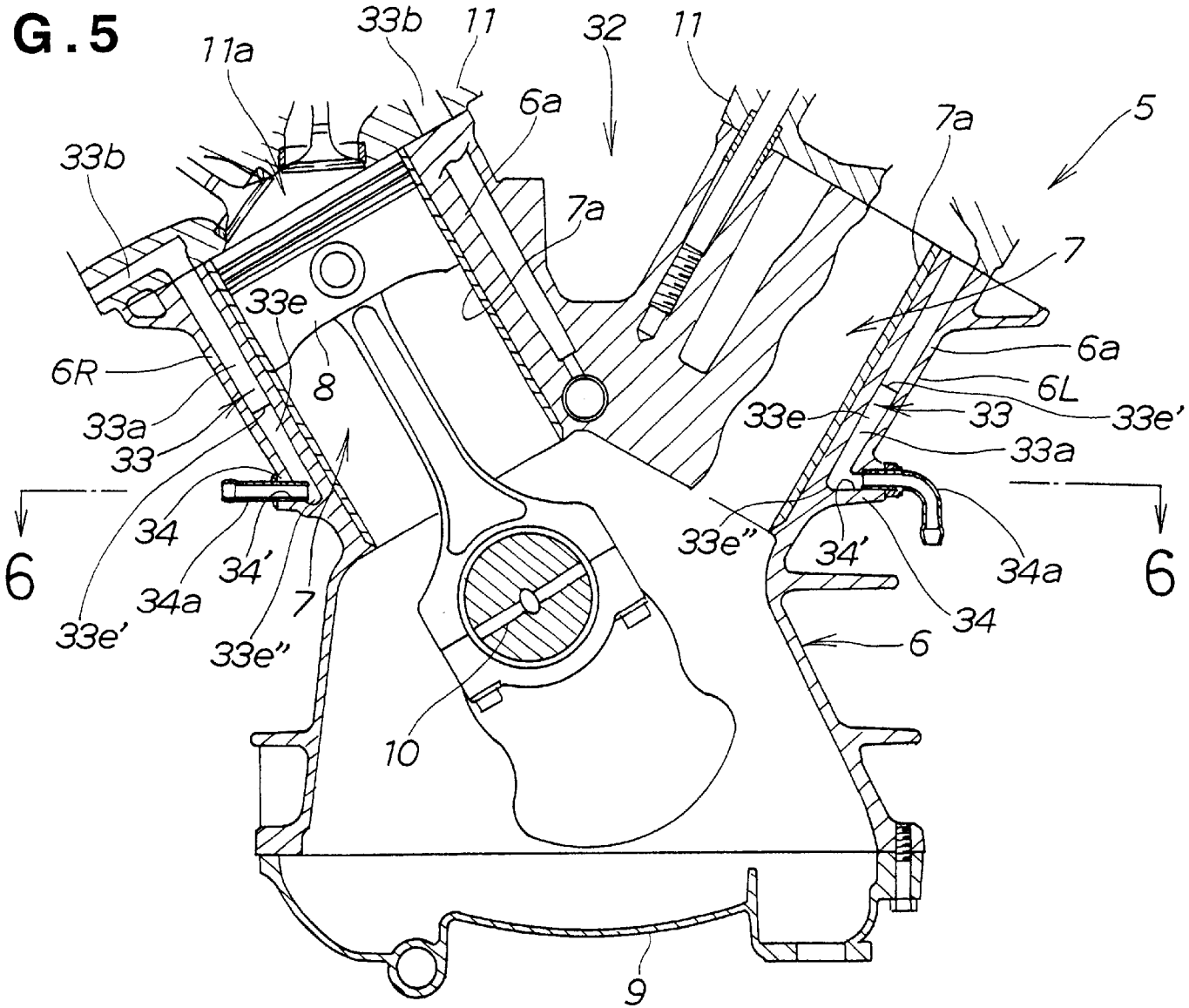
FIG. 5 is a view illustrating, in cross-section, lowermost cylinders of the engine.
Figure 6:
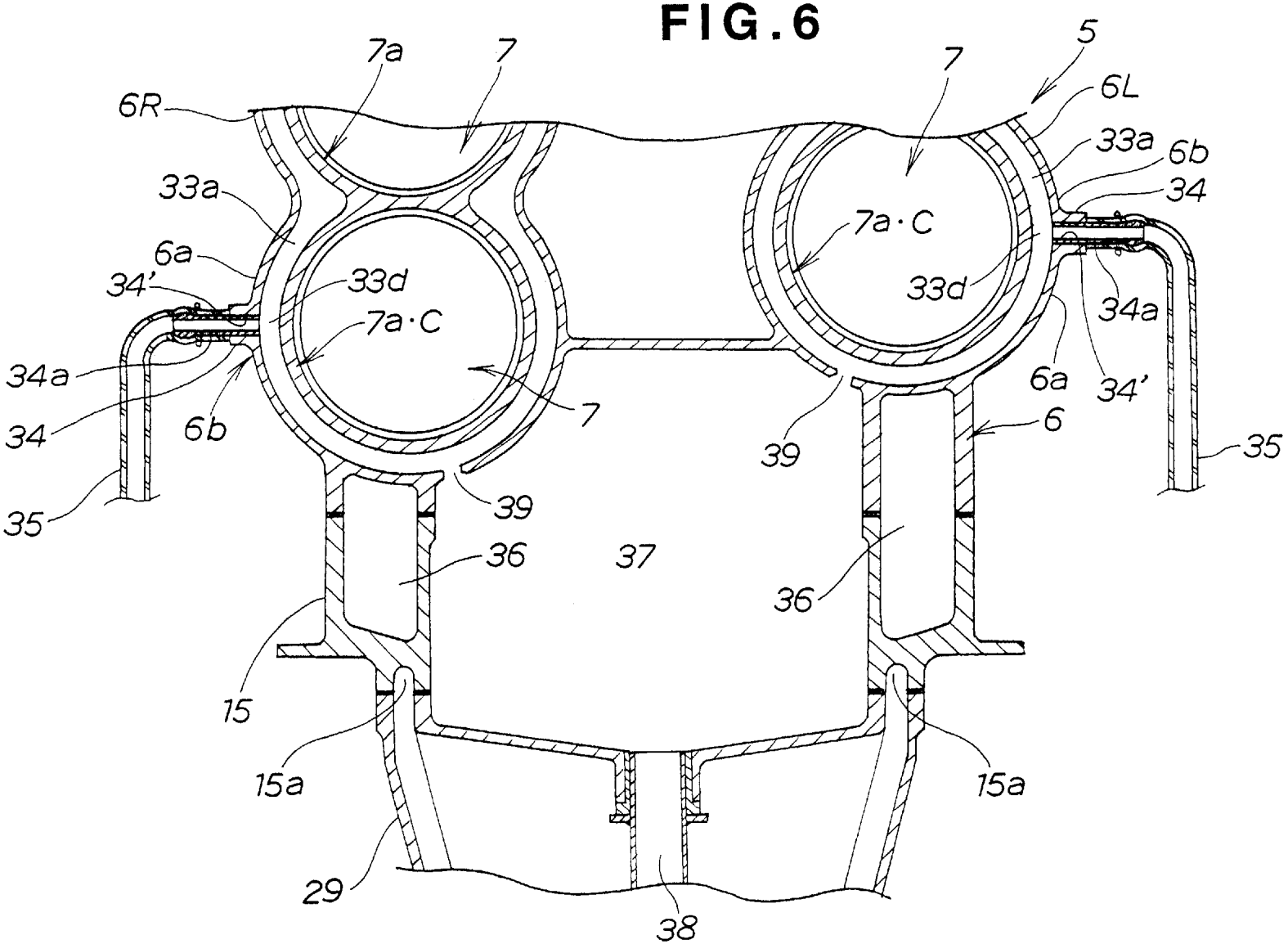
FIG. 6 is a cross-sectional view taken along line 6—6 of FIG. 5.

Reference is made to FIG. 5 and FIG. 6. There are shown lowermost cylinders 6*a*, 6*a* of the right and left cylinder block portions 6R, 6L. Around the cylinder bores 7*a*, 7*a* of the lowermost cylinders 6*a*, 6*a*, there are provided cooling water jackets (cooling jackets) 33*a*, 33*a*. It should be noted that the cooling water jackets 33*a*, 33*a* surround cylinder bores of the uppermost and middle cylinders 7, 7 as well as those of the lowermost cylinders 6*a*, 6*a*.

Each cooling water jacket 33*a* communicates with both a cooling water jacket 33*b* provided around the combustion chamber 11*a* and a cooling water jacket 33*c* provided around the exhaust passageway 14.

Each of the lowermost cylinders 6*a*, 6*a* has an outermost part 6*b*. The outermost part 6*b* has a discharge portion 34 positioned at the same level as the center C of the cylinder bore 7*a* of the lowermost cylinder 6*a*.

The discharge portion 34 is of cylindrical configuration and protrudes outwardly from the outermost part 6*b*. The discharge portion 34 has a passageway 34' formed therein. The passageway 34' of the discharge portion 34 communicates with a water passageway 33*d* forming in part the cooling water jacket 33*a* surrounding the cylinder bores, and an outlet of the cooling water jacket 33*a* opens directly to the discharge portion 34. The cylindrical discharge portion 34 has a fitting 34*a* inserted into the passageway 34' thereof. The fitting 34*a* is a pipe and its outer end connected to a drainage tube 35.

The discharge portions 34, 34 discharge cooling water remaining within the cooling water jackets 33*a*, 33*a* when the engine 5 is out of operation, as will be described hereafter.

Cooling water passages 36, 36 are formed at right and left sides of the mount case 15. The mount case 15 has a cooling water introducing passageway 37 formed therein. The passageway 37 is provided between the passages 36, 36. The passageway 37 communicates with a cooling water supplying pipe 38. Cooling water such as sea water is pumped up through the pipe 38 into the passageway 37. The cooling water within the passageway 37 is then introduced into the cooling water jackets 33*a*, 33*a* through introduction ports 39, 39 formed in the cylinder block portions 6R, 6L.

The drainage tubes 35, 35 communicate with the cooling water jackets 33*c*, 33*c*.

Figure 7:
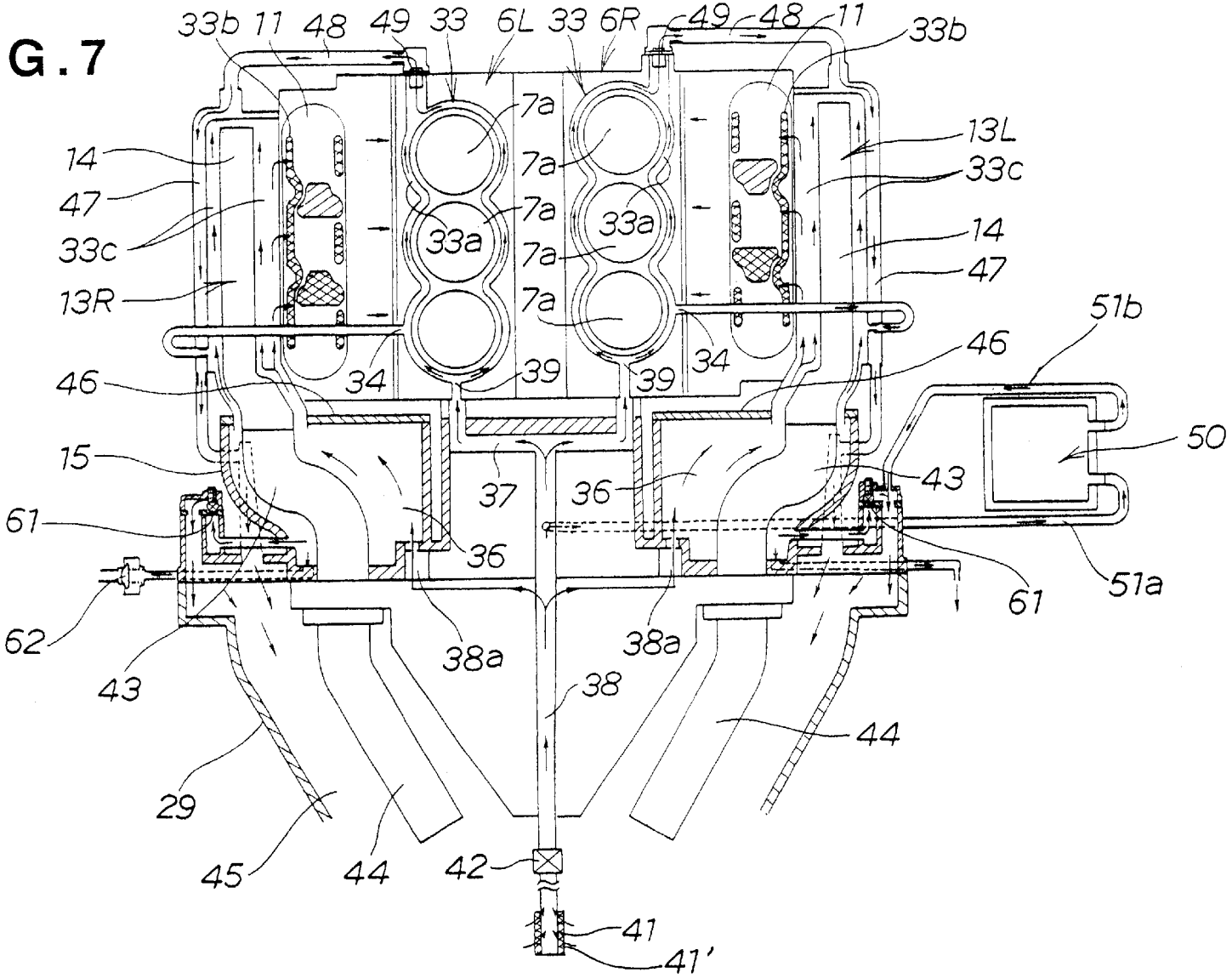
FIG. 7 is a view schematically illustrating how cooling water flows within cooling water jackets formed in the engine.

When the engine 5 and a pump 42 (see FIG. 7) become out of operation, cooling water within the water passageways 33*d*, 33*d* flows back into the drainage tubes 35, 35 through the cooling water jackets 33*c*, 33*c*, the cooling water passages 36, 36 and the cooling water supplying pipe 38 out of an intake port 41 (see FIG. 7).

Discussion will be made as to the flow of cooling water with reference to FIG. 7.

When the pump 42 is actuated, cooling water such as sea water is pumped up through the intake port 41 into the pipe 38, as shown by arrows. The intake port 41 is provided with a strainer 41'. The cooling water is then forced through the introduction ports 39, 39 into the cooling water jackets 33*a*, 33*a* to thereby cool the respective cylinder bores of the cylinders of the cylinder block portions 6R, 6L, as shown by arrows.

Part of the pumped cooling water flows through branch passages 38*a*, 38*a* and the passages 36, 36 into the cooling water jackets 33*c*, 33*c* of the exhaust manifolds 13R, 13L to thereby cool the exhaust passageways 14, 14. The cooling water thus introduced into the cooling water jackets 33*a*, 33*a*, 33*c*, 33*c* flows into the cooling water jackets 33*b*, 33*b* of the cylinder heads 11, 11 to thereby cool the combustion chambers.

The exhaust manifolds 13R, 13L are connected to mount case inside passage members 43, 43. The cooling water passages 36, 36 are provided around the passage members 43, 43, respectively. Each cooling water passage 36 is connected to the branch passage 38*a* provided upstream of the pipe 38. The part of the cooling water flows through the branch passages 38*a*, 38*a* into the cooling water passages 36, 36 to thereby cool the passage members 43, 43.

The mount case inside passage members 43, 43 have their lower ends connected to the exhaust pipes 44, 44, respectively. These pipes 44, 44 extend within the exhaust gas expansion chamber 45. Exhaust gas and the cooling water flow through the pipes 44, 44 and the chamber 45, respectively, out of the outboard motor 1.

Covers 46, 46 are disposed on the mount case 15 in such a manner as to allow the connection of the exhaust manifolds 13R, 13L to the mount case inside passage members 43, 43.

Thermostats 49, 49 are positioned atop the cooling water jackets 33*a*, 33*a* of the cylinder block portions 6R, 6L. As shown in FIG. 4, the cooling water jackets 33*c* and a discharge passage 47 are provided around the exhaust manifold. The cooling water jackets 33*a*, 33*a* are connected via connection paths 48, 48 to the discharge passages 47, 47, as shown in FIG. 7.

The thermostats 49, 49 are opened when temperature of the cooling water within the cooling water jackets 33*a*, 33*a* exceeds a given value. With the thermostats 49, 49 opened, the cooling water flows through the connection paths 48, 48 into the discharge passages 47, 47. The cooling water in the discharge passages 47, 47 is then discharged into the chamber 45. The discharge passages 47, 47 have their exits 47*a*, 47*a* communicating with discharge apertures 15*a*, 15*a*. These apertures 15*a*, 15*a* are in communication with the exhaust gas expansion chamber 45.

Referring back to FIG. 3 and FIG. 5, the cooling water jackets 33*a*, 33*a* of the cylinder block portions 6R, 6L each include an inside wall (an inside bottom portion) 33*e* contiguous with the discharge portion 34. The inside wall 33*e* is inclined forwardly of the outboard motor 1. The inside wall 33*e* has distal and proximal ends 33', 33*e*". The distal end 33*e*' is positioned lower than the proximal end 33*e*".

When the outboard motor 1 is tilted up, as shown by the double-dot-and-dash line A in FIG. 1, to thereby turn the inside walls 33*e*, 33*e* clockwise, the cooling water within the cooling water jackets 33*a*, 33*a* is positively or forcibly directed along the inside walls 33*e*, 33*e* into the discharge portions 34, 34.

Reference numeral 50 is a cooling jacket for a vapor separator. The cooling water supplying pipe 38 is connected to a cooling pipe 51*a*. A drainage pipe 51*b* is provided for discharging cooling water into the exhaust gas expansion chamber 45. Provided at the right and left cooling water passages 36, 36 are water pressure relief valves 61, 61 for adjusting pressure in any water passage through which cooling water pumped by the pump 42 flows prior to reaching the thermostats 49, 49. Each cooling water passage 36 communicates with the chamber 45 through the valve 61. When pressure of cooling water supplied by the pump 42 becomes high, the valves 61, 61 are each opened to thereby allow cooling water within the passages 36, 36 to be drained into the chamber 45. The use of the valves 61, 61 makes it possible to adjust the pressure of the cooling water pumped by the pump 42.

In the illustrated embodiment, sea water is pumped up by the pump 42 to cool the engine 5, therefore, the outboard motor 1 includes a one way valve 62 for cleaning/washing the cooling water jackets. The valve 62 is opened only in cleaning the cooling water jackets. More specifically, when in use, the valve 62 is connected via a hose to an external faucet disposed outside the outboard motor 1. Fresh water is then supplied from the faucet through the hose and the opened valve 62 into the outboard motor 1. The valve 62 is normally closed.

The outboard motor 1 can be tilted or pivoted upwardly on the shaft 3 as shown by the double-dot-and-dash line A of FIG. 1 for the purpose of maintenance. The outboard motor 1 can also be pivoted rightward or otherwise leftward on the shaft 4 for the purpose of maintenance.

With the outboard motor 1 tilted up and pivoted either rightward or leftward, cooling water within the cooling water jackets 33*a*, 33*a* needs to be discharged out so as to prevent corrosion or rusting of the engine 5.

In the illustrated embodiment, as stated above, the discharge portions 34, 34 are provided adjacent to the lower ends of the lowermost cylinders 6*a*, 6*a* remote from the cylinder heads 11, 11 at the same level as the centers C, C of the cylinders bores 7*a*, 7*a* of the lowermost cylinders 6*a*, 6*a*. When the outboard motor 1 is tilted up and pivoted sideways, either of the discharge portions 34, 34 is lowered. Therefore, cooling water within the cooling water jacket 33*a* can be discharged out of the outboard motor 1 through the thus lowered discharge portion 34, the cooling water jacket 33*c*, the cooling water passage 36, and the cooling water supplying pipe 38.

It will be appreciated that even when the outboard motor is tilted up and pivoted sideways for the purpose of maintenance, the cooling water remaining within the cooling water jackets can be smoothly, rapidly discharged out of the outboard motor.

The present disclosure relates to the subject matter of Japanese Patent Application No. 2001-144546, filed May 15, 2001, the disclosure of which is expressly incorporated herein by reference in its entirety.

What is claimed is:

1. An outboard motor mountable in use on a boat in such a manner as to undergo tilting movement about a horizontal axis and pivotal movement about a vertical axis, the outboard motor comprising: a water-cooled V-engine having two cylinder heads disposed at a rearward portion of the outboard motor and a crankcase disposed at a forward portion of the outboard motor, the V-engine having right and left lateral sides having corresponding right and left cylinder block portions each having plural cylinders disposed in vertical juxtaposition with axes of the cylinders disposed horizontally, the cylinder block portions each having a cooling jacket formed therein and extending around each of the cylinders thereof for the passage therethrough of cooling water to cool the cylinders, each of the cylinder block portions having a discharge portion disposed in a position corresponding to the position of a lowermost cylinder of the plural cylinders in each cylinder block portion, and each cooling jacket having an outlet opening to a respective one of the discharge portions.

2. An outboard motor according to claim 1; wherein the cooling jackets of the right and left cylinder block portions each have an inclined bottom portion contiguous to the outlet thereof and sloping upward in a forward direction of the outboard motor so that when the outboard motor is tilted up in a rearward direction thereof, cooling water remaining in the cooling jacket is allowed to escape the cooling jacket successively through the inclined bottom portion and the outlet.

3. An outboard motor according to claim 1; wherein the outlet of each cooling jacket is located at the same level as the axis of the lowermost cylinder.

4. An outboard motor according to claim 1; wherein the outlet of each cooling jacket is disposed adjacent to an end of the lowermost cylinder located remote from the cylinder head.

5. An outboard motor mountable in use in an upright position on a boat to undergo tilting movement about a horizontal axis and sidewise pivotal movement about a vertical axis, the outboard motor comprising: a water-cooled V-engine having two cylinder heads disposed at a rearward portion of the outboard motor and a crankcase disposed at a forward portion of the outboard motor, the V-engine having right and left cylinder block portions each having plural cylinders disposed one above the other with axes of the cylinders disposed horizontally when the outboard motor is in the upright position, the cylinder block portions each having a cooling jacket formed therein and extending around each of the cylinders thereof for the passage therethrough of cooling water to cool the cylinders, each of the cooling jackets having an outlet disposed in a position corresponding to the position of a lowermost cylinder of the plural cylinders in a respective cylinder block portion for draining cooling water from the cooling jackets when, during non-use of the outboard motor, the outboard motor is tilted upwardly and pivoted sidewise.

6. An outboard motor according to claim 5; wherein the cooling jackets of the right and left cylinder block portions each have an inclined bottom portion contiguous to the outlet thereof and sloping upward in a forward direction of the outboard motor so that cooling water can drain from the cooling jacket successively through the inclined bottom portion and the outlet when the outboard motor is tilted upwardly.

7. An outboard motor according to claim 5; wherein the outlet of each cooling jacket is located at the same level as the axis of the lowermost cylinder.

8. An outboard motor according to claim 5; wherein the outlet of each cooling jacket is disposed adjacent to an end of the lowermost cylinder located remote from the cylinder head.

9. An outboard motor according to claim 8; wherein the cooling jackets of the right and left cylinder block portions each have an inclined bottom portion contiguous to the outlet thereof and sloping upward in a forward direction of the outboard motor so that cooling water can drain from the cooling jacket successively through the inclined bottom portion and the outlet when the outboard motor is tilted upwardly.

* * * * *